US012434750B2

(12) United States Patent
Tione et al.

(10) Patent No.: US 12,434,750 B2
(45) Date of Patent: Oct. 7, 2025

(54) MONITORING SYSTEM FOR A PLURALITY OF HOMOGENEOUS DEVICES OF AT LEAST TWO CONVOYS, IN PARTICULAR TWO RAILWAY CONVOYS

(71) Applicant: FAIVELEY TRANSPORT ITALIA S.P.A., Turin (IT)

(72) Inventors: Roberto Tione, Turin (IT); Matteo Frea, Turin (IT)

(73) Assignee: Faiveley Transport Italia S.P.A., Turin (IT)

( * ) Notice: Subject to any disclaimer, the term of this patent is extended or adjusted under 35 U.S.C. 154(b) by 121 days.

(21) Appl. No.: 18/263,877

(22) PCT Filed: Feb. 2, 2022

(86) PCT No.: PCT/IB2022/050905

§ 371 (c)(1),
(2) Date: Aug. 1, 2023

(87) PCT Pub. No.: WO2022/167949

PCT Pub. Date: Aug. 11, 2022

(65) Prior Publication Data

US 2024/0116552 A1 Apr. 11, 2024

(30) Foreign Application Priority Data

Feb. 2, 2021 (IT) ..... 102021000002213

(51) Int. Cl.
*B61L 15/00* (2006.01)

(52) U.S. Cl.
CPC ..... *B61L 15/0081* (2013.01); *B61L 15/0027* (2013.01)

(58) Field of Classification Search
CPC ..... B61L 15/0081; B61L 15/0027
See application file for complete search history.

(56) References Cited

U.S. PATENT DOCUMENTS 9,365,222 B2 6/2016 Hawthorne et al.
10,259,478 B1 * 4/2019 Gao ..... B61L 27/20
(Continued)

FOREIGN PATENT DOCUMENTS

EP 3074831 B1 12/2020
WO 2016042756 A1 3/2016

OTHER PUBLICATIONS

ISA European Patent Office, International Search Report Issued in Application No. PCT/IB2022/050905, May 12, 2022, WIPO, 3 pages.

*Primary Examiner* — Long T Tran
(74) *Attorney, Agent, or Firm* — K&L Gates LLP

(57) ABSTRACT

A monitoring system for at least one plurality of homogeneous devices is described, wherein a first portion of the homogeneous devices is arranged to be installed in a first convoy and a second portion of the homogeneous devices is arranged to be installed in a second convoy. A functional state of each device is represented by a respective value of at least one operational quantity common to the plurality of homogenous devices. The monitoring system comprises first communication means arranged to allow the transmission of a first plurality of values and a second plurality of values, at least one first diagnostic means arranged to detect an operational fault or a maintenance request from the at least one device that is installed in the first convoy, and at least one second diagnostic means included in the second convoy arranged to detect an operational fault or a maintenance request from the at least one device that is installed in the second convoy.

20 Claims, 8 Drawing Sheets

(56) References Cited

U.S. PATENT DOCUMENTS

| | | | | |
|---|---|---|---|---|
| 2016/0359741 | A1* | 12/2016 | Cooper | H04W 4/44 |
| 2017/0210401 | A1* | 7/2017 | Mian | B61L 15/0072 |
| 2017/0217457 | A1* | 8/2017 | Fischer | B61L 15/0081 |
| 2017/0232982 | A1 | 8/2017 | Itakura | |
| 2017/0349193 | A1 | 12/2017 | Fischer | |
| 2018/0017417 | A1 | 1/2018 | Kickham | |
| 2019/0092357 | A1* | 3/2019 | Mizuno | B61L 27/40 |
| 2019/0263432 | A1* | 8/2019 | Carlson | B61L 27/70 |
| 2022/0032978 | A1* | 2/2022 | Haas | B61L 15/0018 |

* cited by examiner

| | X(t) | Y(t) | Z(t) | | | H(t) | K(t) | J(t) |
|---|---|---|---|---|---|---|---|---|
| 1 | $x_1(aT)$ | $y_1(aT)$ | $z_1(aT)$ | | | $h_1(aT)$ | $k_1(aT)$ | $j_1(aT)$ |
| 2 | $x_3(aT)$ | $y_3(aT)$ | $z_3(aT)$ | | | $h_3(aT)$ | $k_3(aT)$ | $j_3(aT)$ |
| 3 | $x_n(aT)$ | $y_n(aT)$ | $z_n(aT)$ | | | $h_n(aT)$ | $k_n(aT)$ | $j_n(aT)$ |
| | | | | | | | | |
| r-1 | $x_2(bT)$ | $y_2(bT)$ | $z_2(bT)$ | | | $h_2(bT)$ | $k_2(bT)$ | $j_2(bT)$ |
| r | $x_1(bT)$ | $y_1(bT)$ | $z_1(bT)$ | | | $h_1(bT)$ | $k_1(bT)$ | $j_1(bT)$ |
| r+1 | $x_n(bT)$ | $y_n(bT)$ | $z_n(bT)$ | | | $h_n(bT)$ | $k_n(bT)$ | $j_n(bT)$ |

FIG. 5

MONITORING SYSTEM FOR A PLURALITY OF HOMOGENEOUS DEVICES OF AT LEAST TWO CONVOYS, IN PARTICULAR TWO RAILWAY CONVOYS

CROSS REFERENCE TO RELATED APPLICATIONS

The present application is a U.S. National Phase of International Application No. PCT/IB2022/050905 entitled "MONITORING SYSTEM FOR A PLURALITY OF HOMOGENEOUS DEVICES OF AT LEAST TWO CONVOYS, IN PARTICULAR TWO RAILWAY CONVOYS," and filed on Feb. 2, 2022. International Application No. PCT/IB2022/050905 claims priority to Italian Patent Application No. 102021000002213 filed on Feb. 2, 2021. The entire contents of each of the above-listed applications are hereby incorporated by reference for all purposes.

TECHNICAL FIELD

This invention relates, in general, to the field of vehicles, in particular railway vehicles. In particular, the invention refers to a monitoring system of at least one plurality of homogeneous devices of at least two convoys, in particular for safety applications in the field of transport, for example railway transport.

PRIOR ART

The prior art will be described below with particular reference to the field of railway vehicles. That which is described may also apply, where possible, to vehicles in other fields.

A railway convoy 100 of modern design is illustrated in FIG. 1.

The railway convoy 100 is composed of a plurality of vehicles 101, each of which is equipped with at least one braking system 102, at least one access door system 103, and at least one air conditioning and heating unit 104.

Further, the railway convoy 100 is equipped with a plurality of pantographs 105 and a plurality of units for generating, filtering, and drying compressed air 106.

The railway convoy 100 is equipped with other pluralities of systems or components, not shown in the figure, such as, for example but not exclusively, bogie suspension units, toilets, etc.

The previously illustrated systems are each controlled by one or more electronic control units, not illustrated in the figure. The electronic control units communicate with each other through a communication means of a typically serial nature, which is also not illustrated in FIG. 1.

Each electronic control unit acquires electrical signals from transducers adapted to measure operational quantities characteristic of the system to which they are associated and generates electrical control signals to control the associated system. Each control unit, based on the analysis of these electrical signals, performs diagnostic functions as well as control functions.

The diagnostic functions normally perform the comparison between the operational quantities measured or generated by the respective electronic control units, possibly preprocessed, with diagnostic comparison parameters preloaded in the non-volatile memory of said electronic control units. The diagnostic parameters are characteristic of the correct operational state, the pre-alarm state, and the alarm state of a system. The diagnostic parameters are defined in the system design phase.

Said diagnostic parameters, if designed on the basis of purely theoretical calculations or on the basis of laboratory experiments, often require further revisions based on the operational conditions of the convoy.

WO2016041756 claims various aspects of a method for performing diagnostic functions on systems and/or components on board a railway vehicle, and in particular a method for updating the diagnostic algorithms on board a train and/or the corresponding parameters from a remote server.

In the daily routine, for reasons of operational security and cybersecurity, railway operators are hostile to remote access to operational or diagnostic parameters of on-board vehicle systems.

SUMMARY OF THE INVENTION

An object of this invention is thus to provide a monitoring system of at least one plurality of homogeneous devices of at least two convoys, in particular two railway convoy, which is independent of the need for remote updates.

A further object of this invention is therefore that of providing a solution which resolves the counterproductive cases of known monitoring systems, through a solution with reduced complexity and costs.

Thus, a further object of this invention is to provide a solution that is capable of collecting, more rapidly than in the prior art, a plurality of operational information adapted to allow for monitoring the operation of a plurality of homogeneous devices of a plurality of convoys, in particular railway convoys.

The aforesaid and other objects and advantages are achieved, according to an aspect of the invention, by a monitoring system for at least one plurality of homogeneous devices of at least two convoys, having the features defined in claim 1, and a monitoring system for at least one plurality of homogeneous devices, of at least two convoys, having the features defined in claim 2. Preferred embodiments of the invention are defined in the dependent claims, the content of which is to be understood as an integral part of this description.

BRIEF DESCRIPTION OF THE DRAWINGS

The functional and structural features of some preferred embodiments of an electronic control system for emergency and service braking according to the invention will now be described. Reference is made to the accompanying drawings, wherein:

FIG. 5 shows in detail a possible format of records contained in a circular buffer.

DETAILED DESCRIPTION

Figure 1:
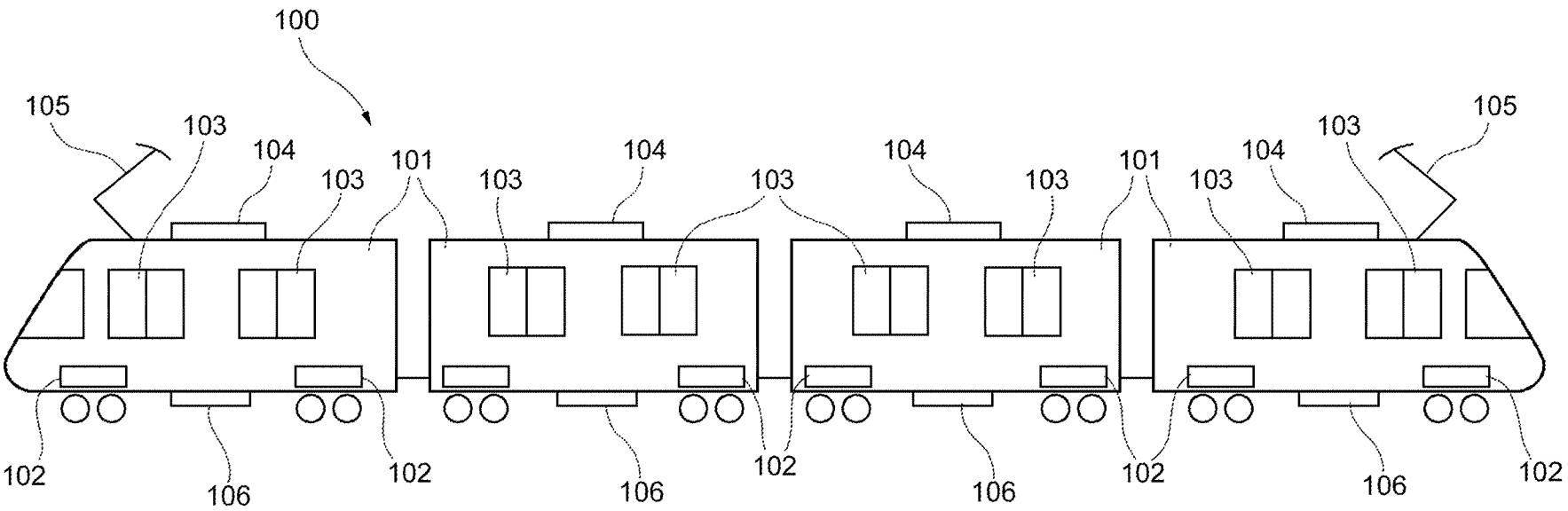
FIG. 1 shows an example of a convoy, in particular a known railway convoy of modern design.

Before explaining in detail a plurality of embodiments of the invention, it should be clarified that the invention is not limited in its application to the design details and configuration of the components presented in the following description or illustrated in the drawings. The invention is capable of assuming other embodiments and of being implemented or constructed in practice in different ways. It should also be understood that the phraseology and terminology have a descriptive purpose and should not be construed as limiting. The use of "include" and "comprise" and their variations is to be understood as encompassing the elements set out below and their equivalents, as well as additional elements and the equivalents thereof.

In the following, embodiments of a monitoring system for at least one plurality of homogeneous devices 202, 205, belonging to at least two convoys, for example two railway convoys, are described.

Figure 2:
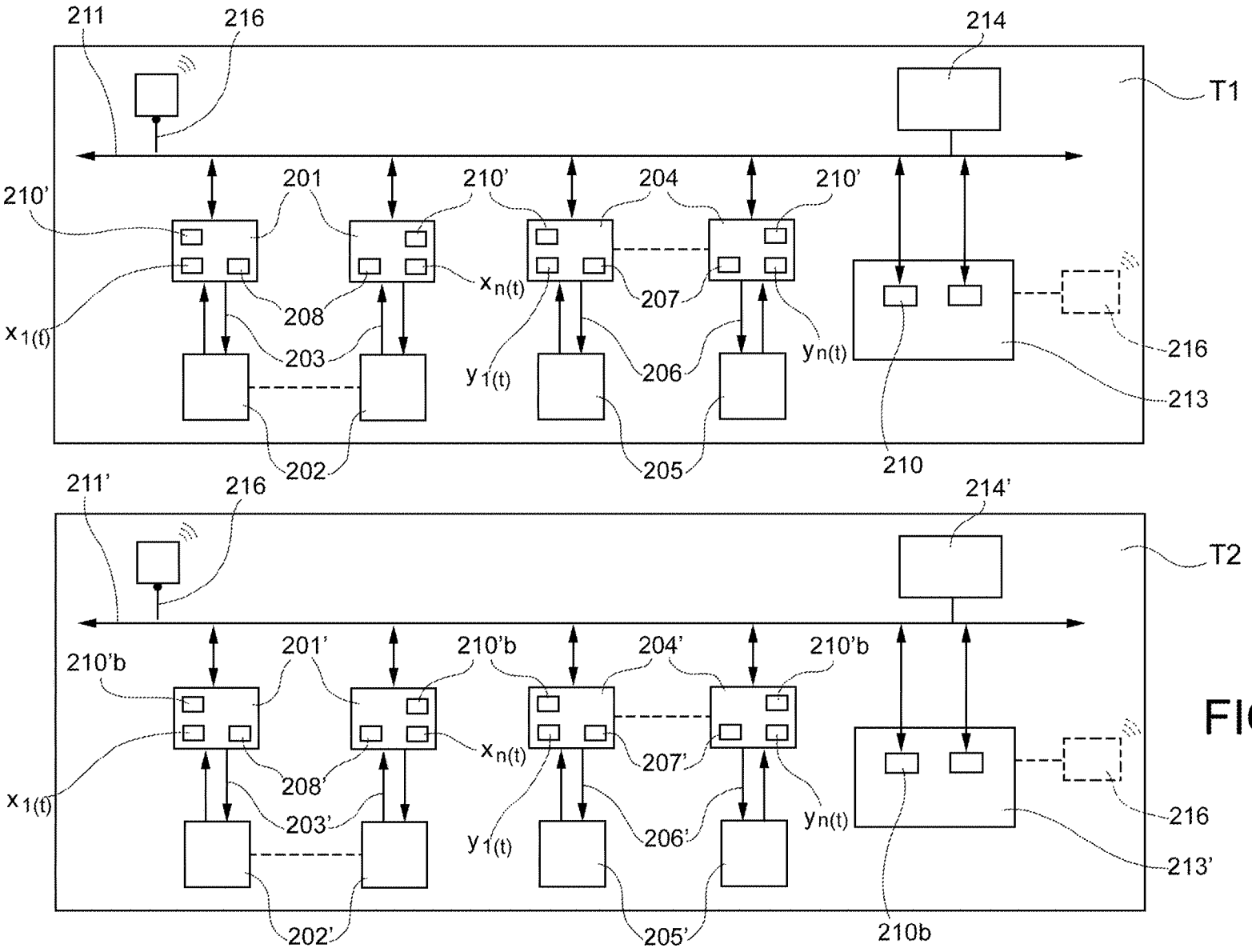
FIG. 2 shows an embodiment of a monitoring system for at least one plurality of homogeneous devices belonging to at least two convoys.

Initially referring to FIG. 2, a first embodiment of a monitoring system for at least one plurality of homogeneous devices 202, 205, 202', 205' is shown.

A first portion of homogeneous devices 202, 205 of the plurality of homogeneous devices 202, 205, 202', 205' is arranged to be installed in a first convoy T1, in particular a first railway convoy, and a second portion of homogeneous devices 202', 205' of the plurality of homogeneous devices 202, 205, 202', 205' is arranged to be installed in a second convoy T2, in particular a second railway convoy.

The functional state of each device of said plurality of homogenous devices 202, 205, 202', 205' is represented by a respective value x1, x2; x1', x2'; y1', y2' of at least one operational quantity X(t), Y(t), . . . common to the plurality of homogenous devices 202, 205, 202' 205'.

The monitoring system comprises at least one first control means 201, 204 included in the first convoy T1. The first control means is designed to acquire, in a temporal succession of first acquisition instants $t_i$, $t_{i+1}$, $t_{i+2}$, . . . determined as a function of a predetermined acquisition period T1, a first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ of the at least one operational quantity X(t); Y(t); . . . .

Each value of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ is representative of the functional state, at one of the first acquisition instants $t_i$, $t_{i+1}$, $t_{i+2}$, . . . , of a respective device of the at least one plurality of devices 202, 205 that is installed in the first convoy.

Further, the monitoring system comprises at least one second control means 201', 204' included in the second convoy. The second control means is arranged to acquire, in a temporal succession of second acquisition instants $t'_i$, $t'_{i+1}$, $t'_{i+2}$, . . . , determined as a function of a second predetermined acquisition period $T'_i$, a second plurality of values $x1'(t'_i, t'_{i+1}, t'_{i+2} \ldots)$, $x2'(t'_i, t'_{i+1}, t'_{i+2} \ldots)$; $y1'(t'_i, t'_{i+1}, t'_{i+2}, \ldots)$, $y2'(t'_i, t'_{i+1}, t'_{i+2}, \ldots)$ of the at least one operational quantity X(t); Y(t); . . . .

Each value of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ is representative of the functional state, at one of the second acquisition instants $t'_i$, $t'_{i+1}$, $t'_{i+2}$, . . . , of a respective device of the at least one plurality of devices 202', 205' that is installed in the second convoy.

Additionally, the monitoring system comprises first communication means arranged to enable the first control means to transmit to the second control means the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$. The first communication means are also arranged to allow the second control means to transmit to the first control means the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}. t'_{i+2}, \ldots)$, $y2'(t'_i, t'_{i+1}, t'_{i+2} \ldots)$.

In other words, in this first embodiment, the at least one first control means and the at least one second control means exchange the respective pluralities of values.

Further, the monitoring system comprises at least one first diagnostic means 210, 210', included in the first convoy, and arranged for:

a) receiving, via a second communication means 211, the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ acquired at one of the first acquisition instants;

b) receiving, from the first control means, the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ that the first control means received from the second control means;

c) detecting a malfunction or a maintenance request from at least one device of the at least one plurality of devices 202, 205, which is installed in the first convoy, as a function of a comparison for each of the first acquisition instants $t_i$, $t_{i+1}$, $t_{i+2}$, . . . , of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(T_i)$ received with at least one first range of reference values.

The first range of reference values comprises a first reference value Mx, My, . . . and a first neighborhood of values ΔMx, ΔMy, . . . associated with the first reference value Mx, My, . . . . The first reference value Mx, My, . . . is determined by the first diagnostic means 210, 210' as a function of at least one value of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ acquired in one of the first acquisition instants and at least one value of the second plurality of values $x1'(t'_i, t'_{i+1}, t'_{i+2}, \ldots)$, $x2'(t'_i, t'_{i+1}, t'_{i+2}, \ldots)$; $y1'(t_i, t_{i+1}, t_{i+2}, \ldots)$, $y2'(t_i, t_{i+1}, t_{i+2}, \ldots)$ acquired in one of the second acquisition instants.

In other words, the first diagnostic means 210, 210' compares, for each of the first acquisition instants $t_i$, $t_{i+1}$, $t_{i+2}$, . . . , the first plurality of values $x1(t_i, t_{i+1}, t_{i+2}, \ldots)$, $x2(t_i, t_{i+1}, t_{i+2}, \ldots)$ $y1(t_i, t_{i+1}, t_{i+2}, \ldots)$, $y2(t_i, t_{i+1}, t_{i+2} \ldots$ which it has received via the second communication means 211 and which relate to the portion of homogeneous devices 202, 205 installed in the first convoy T1, with at least the first range of reference values. The first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$, which pertain to the portion of homogeneous devices 202, 205 installed in the first convoy T1, will then be compared to the first range of reference values that has been determined based on both the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ installed in the first convoy T1 and on the second plurality of values $x1'(t'_i, t'_{i+1}, t'_{i+2}, \ldots)$, $x2'(t'_i, t'_{i+1}, t'_{i+2}, \ldots)$; $y1'(t'_i, t_{i+1}, t'_{i+2}, \ldots)$, $y2'(t'_i, t'_{i+1}, t'_{i+2}, \ldots)$ installed in the second convoy T2.

Still further, the monitoring system comprises at least one second diagnostic means 210*b*, 210*b'* included in the second convoy and arranged for:

a) receiving, via a third communication means 211, the second plurality of values $x1'(t'_i, t'_{i+1}, t'_{i+2}, \ldots$, $x2'(t'_i, t'_1+1, t'_{i+2}, \ldots)$; $y1'(t'_i, t'_1+1, t'_{i+2}, \ldots)$, $y2'(t'_i, t'_{i+1}, t'_{i+2}, \ldots)$ acquired in one of the second acquisition instants;

b) receiving from the second control means the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ which the second control means has received from the first control means;

c) detecting an operational fault or a maintenance request from at least one device of the at least one plurality of devices 202', 205', which is installed in the second convoy, as a function of a comparison for each of said second acquisition instants $t_i$, $t'_{i+1}$, $t'_{i+2}$, . . . , of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ received with at least one second range of reference values.

The second range of reference values comprises a second reference value Mx', My', . . . and a second neighborhood of values ΔMx', ΔMy', . . . associated with the second reference value Mx', My', . . . . The second reference value Mx', My', . . . is determined by the second diagnostic means 210*b*, 210'*b* as a function of at least one value of the second plurality of values $x1'(t'_i, t'_1+1, t'_{i+2}, \ldots)$, $x2'(t'_i, t'_1+1, t'_{i+2}, \ldots)$; $y1'(t_i', t_{i+1}', t_{i+2}', \ldots)$, $y2'(t_i', t'_{i+1}, t'_{i+2}, \ldots)$ acquired in one of the second acquisition instants and at least one value of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ acquired in one of the first acquisition instants.

In other words, the at least one second diagnostic means 210*b*, 210*b*' compares, for each of the second acquisition instants $t'_i$, $t'_{i+1}$, $t'_{i+2}$, . . . , the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ that it has received via a third communication means 211' and that relate to the portion of homogeneous devices 202', 205' installed in the second convoy T2, with at least the second range of reference values. The second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ that relate to the portion of homogeneous devices 202, 205 installed in the second convoy 12, will then be compared with the second range of reference values that was determined based either on the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ installed in the second convoy T2 or on the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ installed in the first convoy T1.

A second embodiment of a monitoring system for at least one plurality of homogeneous devices 202, 205, 202', 205' is described hereinafter, wherein again a first portion of homogeneous devices 202, 205 of the plurality of homogeneous devices 202, 205, 202', 205' is arranged to be installed in a first convoy T1, in particular a first railway convoy, and a second portion of homogeneous devices 202', 205' of the plurality of homogeneous devices 202, 205, 202', 205' is arranged to be installed in a second convoy T2, in particular a second railway convoy.

In this second embodiment, the monitoring system again comprises said at least one first control means (201; 204) included in the first convoy and said at least one second control means 201'; 204'.

With respect to the first embodiment, however, the monitoring system comprises first communication means 216 that are arranged to allow at least one first diagnostic means 210, 210' of the first convoy T1 to transmit the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ to at least one second diagnostic means 210*b*, 210'*b* of the second convoy T2, and to allow at least one second diagnostic means 210*b*, 210'*b* of the second convoy T2 to transmit the second plurality of values $x1'(t'_i, t'_{i+1}, t'_{i+2}, \ldots)$, $x2'(t'_i, t'_i+, t'_{i+2}, \ldots)$; $y1'(t'_i, t'_{i+1}, t'_{i+2}, \ldots)$, $y2'(t'_i, t'_i+, t'_{i+2}, \ldots)$ to at least one first diagnostic means 210, 210' of the first convoy T1.

In other words, in this first embodiment, each first diagnostic means and each second diagnostic means may exchange their respective pluralities of values.

In said case, the first diagnostic means 210, 210' included in the first convoy T1 is arranged for:

a) receiving, via a second communication means 211, the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ acquired in one of said first acquisition instants;

b) receiving, from the second diagnostic means 210*b*, 210'*b*, the second plurality of values $x1'(t'_i, t'_{i+1}, t'_{i+2}, \ldots)$, $x2'(t'_i, t'_1+1, t'_{i+2}, \ldots)$; $y1'(t'_i, t'_1+1, t'_{i+2}, \ldots)$, $y2'(t'_i, t'_{i+1}, t'_{i+2}, \ldots)$;

c) detecting a malfunction or a maintenance request by at least one device of said at least one plurality of devices (202, 205), which is installed in the first convoy, as a function of a comparison for each of said first acquisition instants $t_i$, $t_{i+1}$, $t_{i+2}$, . . . , of said first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(T_i)$ received with at least one first range of reference values;

The second diagnostic means 210*b*, 210'*b* included in the second convoy T2 is arranged for:

a) receiving, via a third communication means 211', the second plurality of values $x1'(t'_i, t'_{i+1}, t'_{i+2}, \ldots)$, $x2'(t', t'_{i+1}, t'_{i+2} \ldots)$; $y1'(t'_i, t'_{i+1}, t'_{i+2}, \ldots)$, $y2'(t', t'_{i+1}, t'_{i+2} \ldots)$ acquired in one of said second acquisition instants;

b) receiving, from the first diagnostic means 210, 210' of the first convoy (T1), the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$; c) detecting a malfunction or a maintenance request by at least one device of said at least one plurality of devices 202', 205', which is installed in the second convoy, as a function of a comparison for each of said second acquisition instants $t_i$, $t'_{i+1}$, $t'_{i+2}$, . . . , of said second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ received with at least one second range of reference values.

In this second embodiment, the first range of reference values comprising the first reference value Mx, My, . . . and the first neighborhood of values ΔMx, ΔMy, . . . associated with the first reference value Mx, My, and the second range of reference values comprising the second reference value Mx', My', . . . and the second neighborhood of values ΔMx', ΔMy', . . . associated with said second reference value Mx', My', may be determined in a manner similar to that already described in the first embodiment.

Preferably, with respect to both the first embodiment and the second embodiment, each first diagnostic means may be arranged to determine the first reference value Mx, My, . . . at each of said first acquisition instants. Each second diagnostic means may be arranged to determine the second reference value Mx', My', . . . at each of said second acquisition instants.

Preferably, with respect to both the first embodiment and the second embodiment, each first diagnostic means may be arranged to determine the first neighborhood of values ΔMx, ΔMy, . . . at each of the first acquisition instants. Each of the second diagnostic means may be arranged to determine the second neighborhood of values ΔMx', ΔMy', . . . at each of the second acquisition instants.

For example, the first neighborhood of values and/or the second neighborhood of values may be a tolerance band around the average.

For example, the first neighborhood of values and/or the second neighborhood of values range may be a constant neighborhood.

For example, the first neighborhood of values and/or the second neighborhood of values may be expressed as a percentage value, possibly with double positive and negative sign, of the respective reference value for comparison, i.e., of the average. This solution offers the advantage of automatically adapting to possible changes in the full scale over time.

For example, the first neighborhood of values and/or the second neighborhood of values may be expressed as a function of the variance of the at least one operational quantity y1(t), y2(t), . . . yn(t). This solution offers the advantage of automatically adapting to the variability of the data.

For example, the first neighborhood of values and/or the second neighborhood of values may be expressed as a set of one or more previously described solutions, and time. This solution offers the advantage of automatically adapting not only to the nature of the data, but also to the dependence on time, such as expected variations due to aging.

An example is the counter of the activation number of a specific solenoid valve present in all of the homogeneous braking systems 102, for example the braking systems associated with the motor bogies.

It is expected for the number of activations of said specific solenoid valve to be on average the same for all the braking systems 102 belonging to the same type of bogie. Potential short-term variations are masked by numerical filtering with a temporal window Δt. A significant deviation from the average value of accumulated pulses of a pneumatic solenoid valve may indicate, for example, a pneumatic leakage of the braking system associated with said pneumatic solenoid valve.

If a given first operational quantity X(t) to be analyzed is affected in a different way by localized non-uniform situations of the convoy, it is expedient to identify at least one second operational quantity Y(t) related to the localized non-uniform situations of the convoy and to normalize the first operational quantity X(t) to be analyzed according to the second operational quantity Y(t).

By way of non-exclusive example, a braking system 102 associated with a load bogie may stress its pneumatic solenoid valves more with respect to a braking system 102 associated with a motor bogie, since the braking system 102 associated with a motor bogie mainly uses the traction motors for braking.

In said case, it would not have meant comparing the activation pulse counters of a specific pneumatic solenoid valve in the whole braking systems 102, whether they are associated with load bogies or motor bogies, as the curves corresponding to the solenoid valves associated with the load bogies would diverge in a short time from the curves corresponding to the solenoid valves associated with the motor bogies.

To resolve this disadvantage, by way of example, it could be appropriate for the first control means 201, 204 associated with respective braking systems 102 of the first convoy to acquire the maximum pressure value to the brake cylinder thereby produced for each braking and calculate continuously and locally its average value $\overline{P}$ and locally normalize the value produced by the local activation pulse counters of the homogeneous solenoid valves according to said average value $\overline{P}$, i.e., divide locally the value accumulated by the pulse counter by said average value $\overline{P}$ obtaining as a result the number of activations per [bar] produced.

In this way, the normalized values of the activation pulse counters of the pneumatic solenoid valves will generate congruent values such that they may be used and compared again.

The same applies similarly to the second control means 201, 204 associated with respective braking systems 102 of the first convoy.

In the following, the definition of homogeneous devices 202, 205; 202', 205' of at least two convoys is explained in detail. A plurality of homogeneous devices means the set of at least two devices 202, 205, 202', 205' performing the same functionality on board at least one vehicle 100 of the first convoy T1 and on board at least one vehicle 100' of the second convoy T2.

The at least one first control means 201, 204 is arranged to control the homogeneous devices 202, 205 installed in the first convoy T1, and the at least one second control means 201', 204' is arranged to control the homogeneous devices 202', 205' installed in the second convoy T2.

The first control means may be only one in the first convoy and may control all the homogeneous devices installed in the first convoy, or the first control means may be more than one and each may control at least one respective homogeneous device installed in the first convoy T1. In the second case, the control means are also homogeneous with each other.

This applies similarly to the second control means. The second control means may be only one in the second convoy and may control all the homogeneous devices installed in the second convoy, or the second control means may be more than one and each control at least one respective homogeneous device installed in the second convoy T2. In the second case, the control means are also homogeneous with each other.

"First or second control means" may refer, for example, to a control unit, a controller, a processor, a control module, a control unit, etc.

By way of example, the plurality of homogeneous devices 202, 202' may be two devices of at least one door system 103 of at least one vehicle of the first convoy T1 and at least one door system 103 of at least one vehicle of the second convoy T2.

The movement of the doors of the first convoy may be controlled by the first control means 201, and the movement of the doors of the second convoy may be controlled by the second control means 201'.

In a further non-limiting example, the plurality of homogeneous devices 205, 205' may be at least one device of electropneumatic braking systems 102 and/or corresponding braking actuators of at least one vehicle of the first convoy T1, and at least one device of electropneumatic braking systems 102 and/or corresponding braking actuators of at least one vehicle of the second convoy T2.

Observing FIG. 2, the first control means 201, 204 may exchange a plurality of first signals, respectively 203, 206, with the associated homogeneous devices 202 and/or 205, respectively. Further, the second control means 201', 204' may exchange a plurality of second signals, respectively 203', 206', with the associated homogeneous devices 202' and/or 205', respectively.

The plurality of first signals 203, 206 may comprise input signals coming from transducers of the first convoy T1 adapted to measure operational quantities characteristic of the associated device and may comprise output signals arranged to control the associated device. The plurality of second signals 203', 206' may comprise input signals coming from transducers of the second convoy T1 adapted to measure operational quantities characteristic of the associated device and may comprise output signals arranged to control the associated device.

For example, in the case wherein the plurality of homogeneous devices comprises devices of door systems 103, the plurality of first signals 203, 206 and of second signals 203', 206', may comprise, respectively, input signals, including rotation speed and position signals of electric motion motors of the doors and end-of-travel signals of the doors, and may comprise output signals, including signals for controlling the power of the electric motors for moving the doors. An example of a plurality of homogeneous devices of a door system may therefore be, for example, a plurality of electric motors for moving the doors, or end-of-travel devices.

As a further example, in the case wherein the plurality of homogeneous devices are braking system devices 102, the plurality of first signals 203, 206 and second signals 203', 206' may comprise, respectively, input signals including speed signals of the axles, signals from various linear or binary pressure sensors adapted to monitor pneumatic pressures at various points of the associated braking system, and may comprise output signals, including control signals of pneumatic solenoid valves used for controlling pressure. An example of a plurality of homogeneous devices of braking systems 102 may therefore be, for example, a plurality of speed sensors, a plurality of linear or binary pressure sensors, or a plurality of pneumatic solenoid valves.

At this point, the first communication means will be further described.

Preferably, referring to the embodiment wherein the at least one first control means and the at least one second control means exchange the plurality of values, the first communication means may be a wireless communication system. Thus, when the first control means and the second control means are within a distance from each other that is less than a predetermined distance threshold:

the first control means may be arranged to transmit the first plurality of values $x1(t_i, t_{i+1}, t_{i+2}, \ldots)$, $x2(t_i, t_{i+1}, t_{i+2}, \ldots)$; $y\ I(t_i, t_{i+1}, t_{i+2}, \ldots)$, $y2(t_i, t_{i+1}, t_{i+2}, \ldots)$ to the second control means via the wireless communication system; and the second control means may be arranged to transmit the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ to the first control means via the wireless communication system.

Preferably, the wireless communication system may comprise a first mesh network included in the first convoy T1 and a second mesh network included in the second convoy T2. In a further embodiment, the first communication means may be a radio communication system. In such a case, when the first control means and the second control means are within any distance of each other:

the first control means may be arranged to transmit the first plurality of values $x1(t_i, t_{i+1}, t_{i+2}, \ldots)$, $x2(t_i, t_{i+1}, t_{i+2}, \ldots)$; $y\ I(t_i, t_{i+1}, t_{i+2}, \ldots)$, $y2(t_i, t_{i+1}, t_{i+2}, \ldots)$ to the second control means via the radio communication system; and the second control means may be arranged to transmit the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ to the first control means via the radio communication system.

Preferably, referring to the embodiment wherein the at least one first diagnostic means and the at least one second diagnostic means exchange the plurality of values, the first communication means may again be a wireless communication system. In said case, however, when said first diagnostic means 210, 210' of the first convoy T1 and the second diagnostic means of 210*b*, 210'*b* of the second convoy T2 are at a distance from each other that is less than a predetermined distance threshold:

the first diagnostic means 210, 210' of the first convoy T1 may be arranged to transmit the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ to the second diagnostic means 210*b*, 210'*b* of the second convoy T2 via the wireless communication system; and the second diagnostic means 210*b*, 210'*b* of the second convoy T2 may be arranged to transmit the second plurality of values $x1'(t'_i, t'_{i+1}, t'_{i+2}, \ldots)$, $x2'(t'_i, t'_{i+1}, t'_{i+2}, \ldots)$;

$y1'(t'_i, t'_{i+1}, t'_{i+2}, \ldots)$, $y2'(t'_i, t'_{i+1}, t'_{i+2}, \ldots)$ to the first diagnostic means 210, 210' of the first convoy T1 via the wireless communication system. Preferably, also the wireless communication system may comprise a first mesh network included in the first convoy and a second mesh network included in the second convoy. Preferably, again, the first communication means may be a radio communication system. In such a case, however, when the first diagnostic means 210, 210' of the first convoy T1 and the second diagnostic means 210*b*, 210'*b* of the second convoy T2 are at any distance from each other:

the first diagnostic means 210, 210' of the first convoy T1 may be arranged to transmit the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2} \ldots)$ to the second diagnostic means 210*b*, 210'*b* of the second convoy T2 via the radio communication system; and the second diagnostic means 210*b*, 210'*b* of the second convoy T2 may be arranged to transmit the second plurality of values $x1'(t'_i, t'_{i+1}, t'_{i+2}, \ldots)$, $x2'(t'_i, t'_{i+1}, t'_{i+2}, \ldots)$;

$y1'(t'_i, t'_{i+1}, t'_{i+2}, \ldots)$, $y2'(t'_i, t'_{i+1}, t'_{i+2}, \ldots)$ to the second diagnostic means 210*b*, 210'*b* of the second convoy 12 via the radio communication system.

In a further example, applicable to either the embodiment wherein the at least one first diagnostic means and the at least one second diagnostic means may exchange the plurality of values, or the embodiment wherein the at least one first control means and the at least one second control means exchange the plurality of values, the first communication means may be a wired communication system.

At this point the first diagnostic means and the second diagnostic means will be further described.

In other words, the first diagnostic means and the second diagnostic means may each be, for example, an algorithm executed within a centralized diagnostic unit 213, 213', or, the first diagnostic means and the second diagnostic means may each be, for example, one or more executed algorithms distributed in the plurality of first control means 201, 204 and second control means 201', 204', respectively.

Further details regarding the operation of the first and second diagnostic means are provided below.

The at least one first diagnostic means 210, 210' may be arranged to perform analysis operations on the plurality of values $x1(t_i, t_{i+1}, t_{i+2}, \ldots)$, $x2(t_i, t_{i+1}, t_{i+2}, \ldots)$ belonging to the operational quantity X(t), in order to identify deviations in behavior of one or more of said values of the plurality of values $x1(t_i, t_{i+1}, t_{i+2}, \ldots)$, $x2(t_i, t_{i+1}, t_{i+2}, \ldots)$, which indicate the occurrence of a fault, malfunction, or a maintenance need due to aging in the monitored systems and/or their associated components.

Upon the occurrence of a fault, a malfunction, or an end-of-life prediction of a component, the at least one first diagnostic means 210, 210' may be arranged to activate an alarm indication, possibly coded to indicate its source and nature, and possibly associated with one or more items of diagnostic information characteristic of the nature of the alarm.

The same applies similarly to the at least one second diagnostic means 210*b*, 210'*b*. The at least one second diagnostic means 210*b*, 210'*b* may be arranged to perform analysis operations on the second plurality of values $x1'(t', t'_{i+1}, t'_{i+2}, \ldots)$, $x2'(t'_i, t'_{i+1}, t'_{i+2}, \ldots)$; $y1'(t_i', t_{i+1}', t_{i+2}', \ldots)$, $y2'(t_i', t_{i+1}', t_{i+2}', \ldots)$ belonging to the operational quantity X(t), in order to identify deviations in behavior of one or more of the values of the second plurality of values $x1'(t'_i, t'_{i+1}, t'_{i+2}, \ldots)$, $x2'(t'_i, t'_{1+1}, t'_{i+2}, \ldots)$; $y1'(t_i', t_{i+1}', t_{i+2}', \ldots)$, $y2'(t_i', t_{i+1}', t_{i+2}', \ldots)$, indicating the occurrence of a failure, malfunction, or a need for maintenance due to aging, in the monitored systems and/or their associated components. Upon the occurrence of a fault, a malfunction, or an end-of-life prediction of a component, the at least one second diagnostic means 210*b*, 210'*b* may be arranged to activate an alarm indication, possibly coded to indicate its source and nature, and possibly associated with one or more items of diagnostic information characteristic of the nature of the alarm.

Subsequent to their generation, the respective alarms and any associated values may be transmitted, by the at least one first diagnostic means or the at least one second diagnostic means that generated the alarm, to a ground data collection and alarm management center by means of wireless transmission means associated with the at least one first diagnostic means and the at least one second diagnostic means, respectively, or to a unit 214, 214' on board the first convoy T1 and the second convoy T2, respectively, adapted to process the received alarms and send them to the driver and/or to the TCMS (Train Control and Monitoring System) which in turn may provide for transmitting said alarm and associated data toward the ground data collection center.

The unit 214 of the first convoy T1 T2 may be an independent unit, or it may coincide with a first control means or multiple first control means 201, 204, or it may also coincide with a TCMS system.

The unit 214' of the second convoy T2 may be an independent unit, or it may coincide with a second control means or multiple second control means 201', 204', or it may also coincide with a TCMS system.

Multiple diagnostic means 210, 210' may be active on the same vehicle of the first convoy or over the entire convoy, wherein each of them may be arranged to analyze one or more common operational quantities X(t), Y(t), . . . . Multiple second diagnostic means 210*b*, 210'*b* may be active on the same vehicle of the second convoy or on the entire second convoy, wherein each of them may be arranged to analyze one or more common operational quantities X(t), Y(t), . . . .

Preferably, the at least one first diagnostic means 210, 210' may be arranged to determine the presence of the operational fault or maintenance request by the at least one device of the at least one plurality of devices 202, 205 comprised in the first convoy T1, when at least one value of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ is not comprised in the first range of reference values.

Preferably, the at least one second diagnostic means 210*b*, 210'*b* may be arranged to determine the presence of the operational fault or maintenance request by the at least one device of the at least one plurality of devices 202', 205' comprised in the second convoy, when at least one value of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ is not comprised in the second range of reference values.

Preferably, the at least one first diagnostic means may be arranged to determine the first reference value Mx, My, . . . calculating an average between at least one value of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ acquired in one of the first acquisition instances $t_i, t_{i+1}, t_{i+2}, \ldots$ and at least one value of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ acquired in one of the second acquisition instants $t'_i, t'_{i+1}, t'_{i+2}, \ldots$.

Preferably, the at least one second diagnostic means may be arranged to determine the second reference value Mx', My', . . . calculating an average between at least one value of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ acquired in one of the first acquisition instances $t_i, t_{i+1}, t_{i+2}, \ldots$ and at least one value of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ acquired in one of the second acquisition instants $t'_i, t'_{i+1}, t'_{i+2}, \ldots$.

The average may be filtered in a time window Δt appropriate for eliminating possible statistical noise.

Preferably, the at least one initial diagnostic means may be arranged for:

determining a first average value by calculating an average of the values of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ acquired at one of the first acquisition instants $t_i, t_{i+1}, t_{i+2}, \ldots$ and of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ acquired in one of the second acquisition instants $t'_i, t'_{i+1}, t'_{i+2}, \ldots$;

identifying the values of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ and of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ which are higher or lower than at least one first given threshold value with respect to the first average value;

determining the reference value Mx, My, . . . by determining a second average value by calculating the average of the values of the first plurality of values $x1(t_i, t_{i+1}, t_{i+2} \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ and of the second plurality of values $x1'(t'_i, t'_{i+1}, t'_{i+2}, \ldots)$, $x2'(t'_i, t'_{i+1}, t'_{i+2}, \ldots)$; $y1'(t', t'_{i+1}, t'_{i+2}, \ldots)$, $y2'(t'_i, t'_{i+1}, t'_{i+2}, \ldots)$ which have not been identified to be greater or lesser than the at least one given threshold value with respect to the first average value.

Preferably, the at least one second diagnostic means may be arranged for:

determining a third average value by calculating an average of the values of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ acquired at one of the first acquisition instants $t_i, t_{i+1}, t_{i+2}, \ldots$ and of the second plurality of values $x1'(t'_i, t'_{i+1}, t'_{i+2}, \ldots)$, $x2'(t'_i,$ $t'_{i+1}, t'_{i+2}, \ldots$); $y1'(t'_i, t'_{i+1}, t'_{i+2}, \ldots)$, $y2'(t'_i, t'_i, t_{i+2}, \ldots)$ acquired in one of the said second acquisition instants $t'_i, t'_{i+1}, t'_{i+2}, \ldots$;

identifying the values of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ and the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ which are greater or lesser than at least one second given threshold value with respect to the third average value;

determining the second reference value Mx', My', . . . through the determination of a fourth average value by calculating the average of the values of the first plurality of values $x1(t_i, t_{i+1}, t_{i+2} \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ and of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ which have not been identified to be greater or lesser than at least one second given threshold value with respect to the third average value.

In other words, it is possible to identify the values that are a value ±S away from the average and recalculate the average M minus the identified values. Thus, a divergent value ym(t) lying beyond the distance ±S from the average M will not affect the definition of the reference value for calculating the neighborhood of variation Δy, making the deviation estimate Δy more reliable.

Preferably, the at least one first diagnostic means may be arranged to determine the first neighborhood of values ΔMx, ΔMy, . . . as a function of a first percentage value of the first reference value Mx, My, . . . .

Preferably, the at least one second diagnostic means may be arranged to determine the second neighborhood of values ΔMx', ΔMy', . . . as a function of a second percentage value of the second reference value Mx', My', . . . .

Or, preferably, the at least one first diagnostic means may be arranged to determine the first neighborhood of values ΔMx, ΔMy, . . . as a function of a first variance of the at least one operational quantity X(t), Y(t), . . . , and the at least one second diagnostic means may be arranged to determine the second neighborhood of values ΔMx', ΔMy', . . . as a function of a second variance of the at least one operational quantity X(t), Y(t), . . . .

Figure 3A:
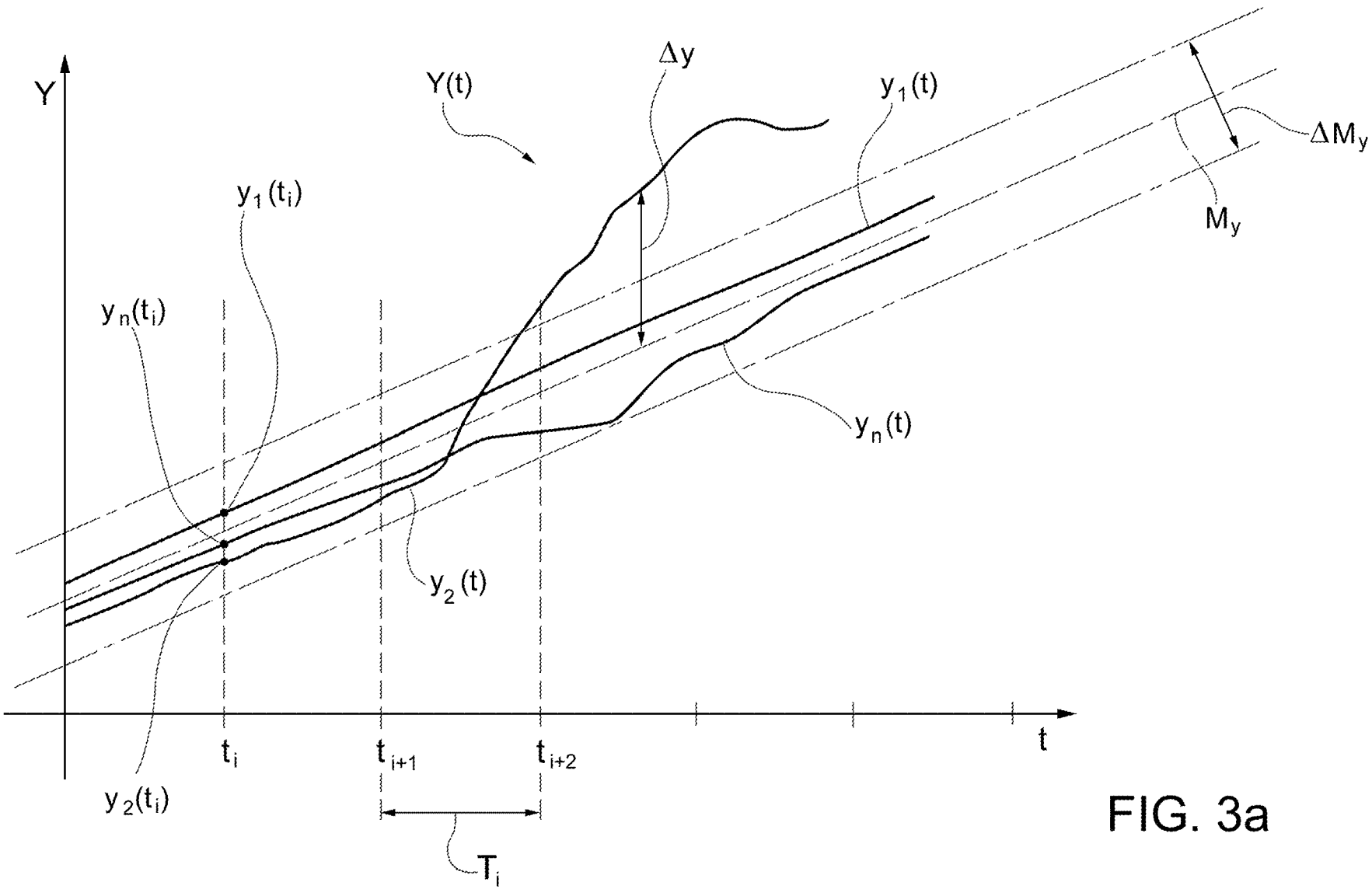
FIGS. 3*a* and 3*b* show curves representing a first plurality of values of respective operational quantities as a function of time.
Figure 3B:
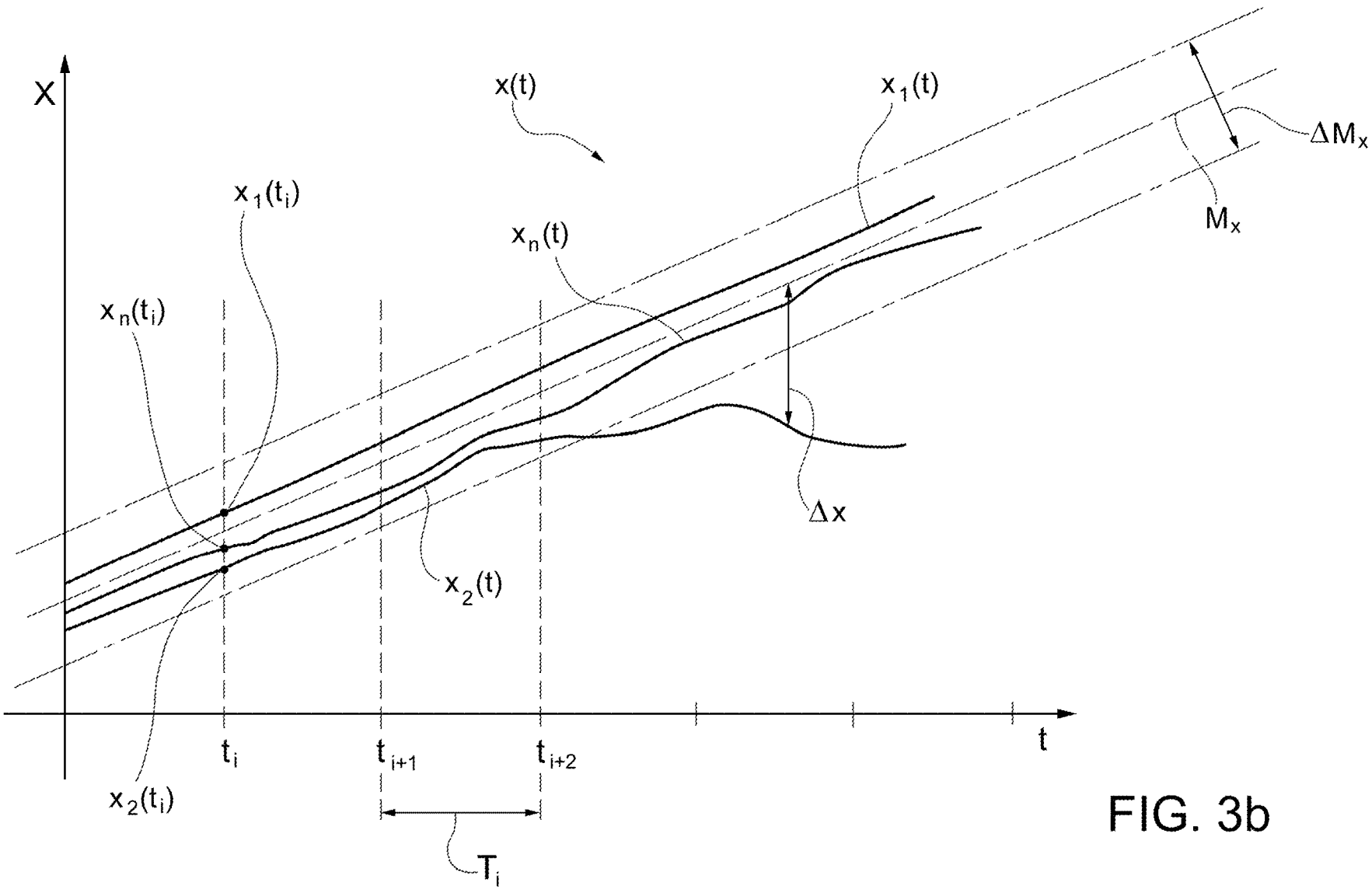
Figure 3C:
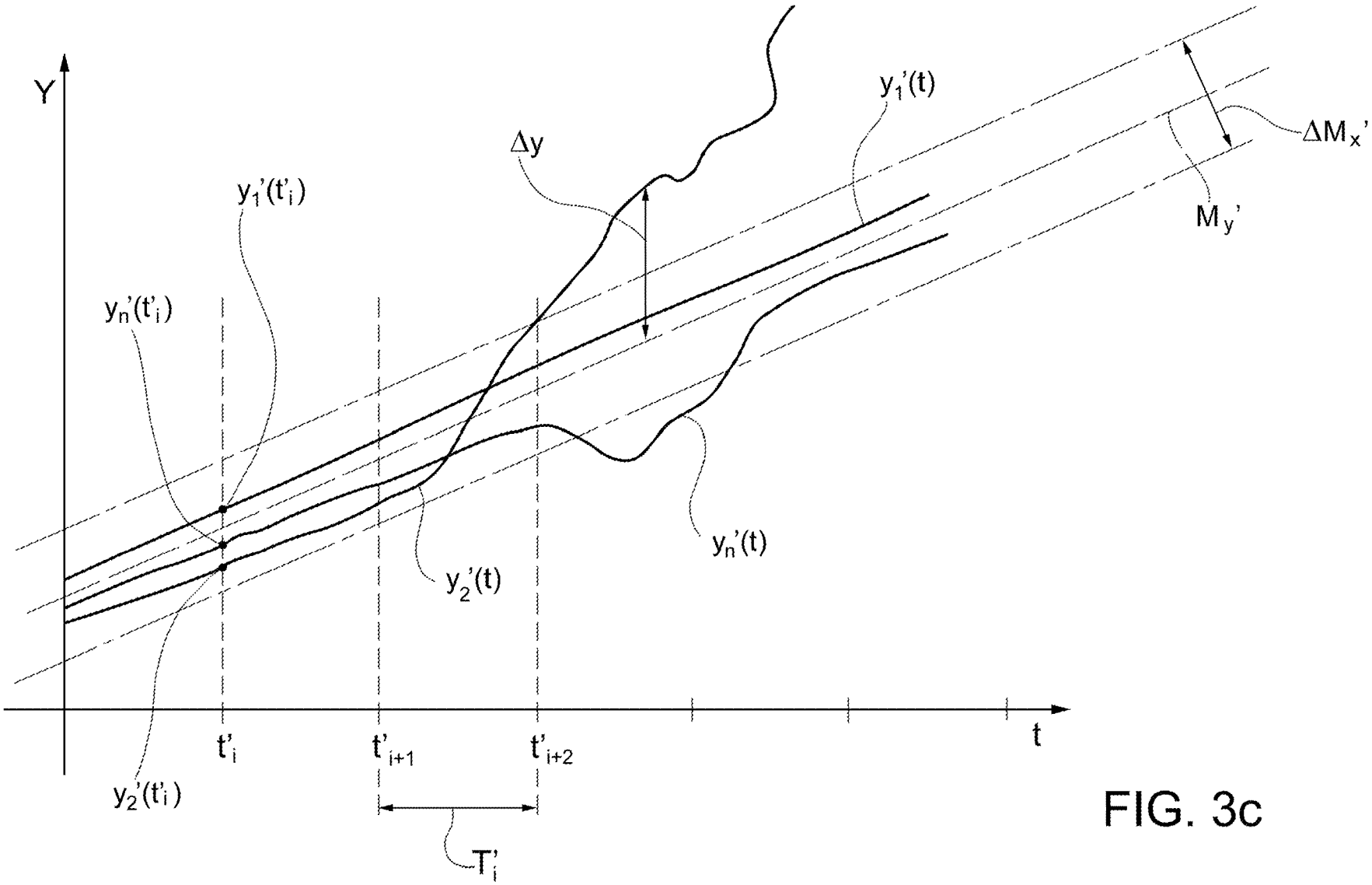
FIGS. 3*c* and 3*d* show curves representing a second plurality of values of respective operational quantities as a function of time.

FIG. 3*a* shows curves $y^1(t), y_2(t), \ldots, y_n(t)$ representing the various values of the operational quantity Y(t) as a function of time, and FIG. 3*c* shows curves $y_1'(t), y_2'(t), \ldots, y_n'(t)$ representing the various values of the operational quantity Y(t) as a function of time.

Figure 3D:
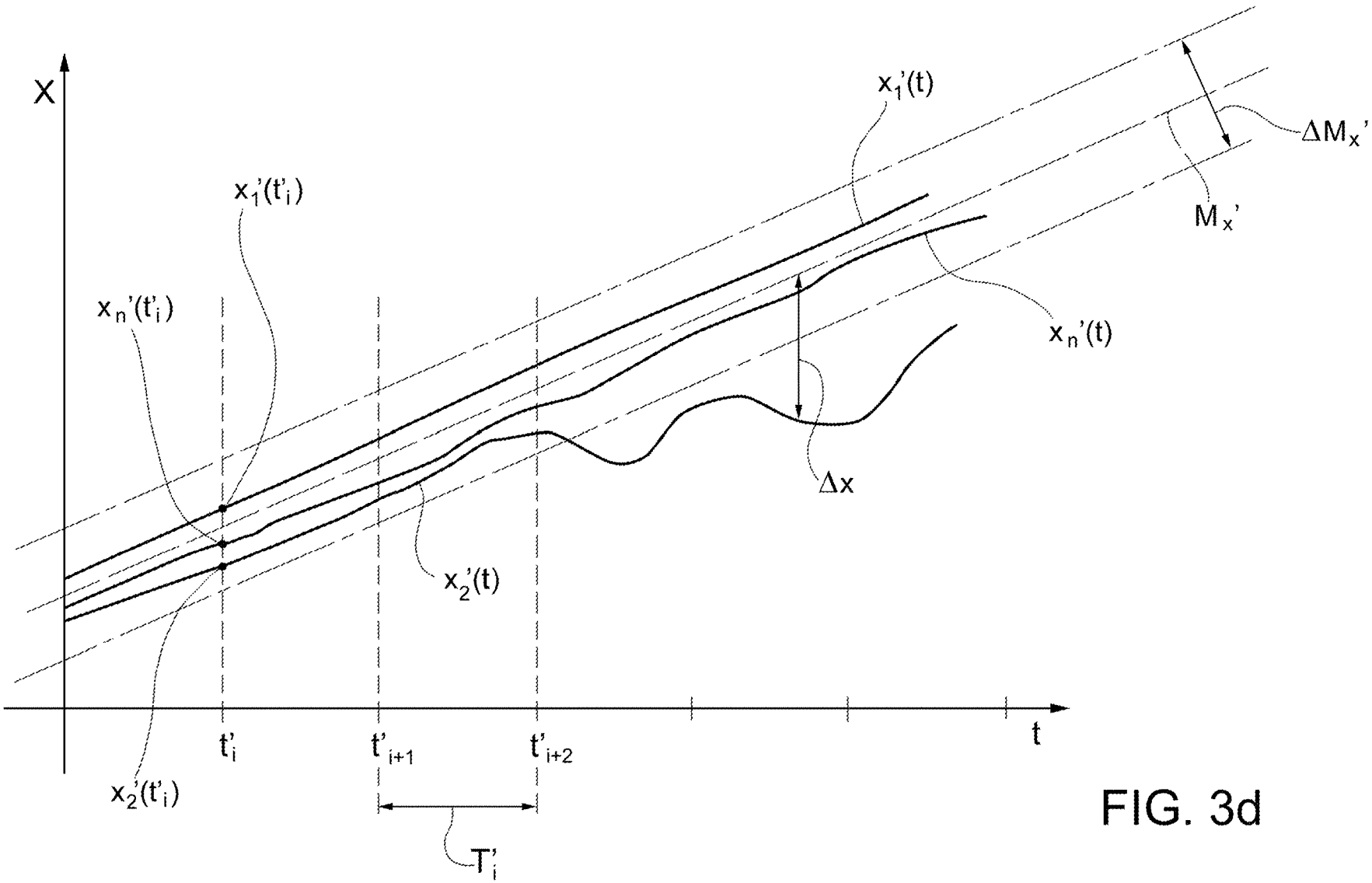

FIG. 3*b* shows curves $x_1(t), x_2(t), \ldots, x_n(t)$ representing the various values of the operational quantity X(t) as a function of time, and FIG. 3*d* shows curves $x_1'(t), x_2'(t), \ldots, x_n'(t)$ representing the various values of the operational quantity X(t) as a function of time.

Preferably, the operational quantities are at least two X(t), Y(t), . . . , i.e., at least one first operational quantity X(t) and a second operational quantity Y(t). In said case, the at least one first diagnostic means and the at least one second diagnostic means may each be arranged to normalize the first operational quantity X(t) as a function of the at least one second operational quantity Y(t).

Preferably, the at least one first diagnostic means may be arranged to determine the first reference value Mx, My, . . . by means of a first neural network 402. The at least one first diagnostic means may be arranged to perform a first training of the first neural network 402, by means of a first training algorithm 403 associated with the first neural network 403. The first training of the first neural network may be performed using a first predetermined quantity Q of values of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ and of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ previously acquired by the first control means 201; 204 or received by the first control means 201; 204 or first diagnostic means 210, 210'.

After the first training is performed, the at least one first diagnostic means may be arranged to perform further training in a temporal succession of first training instants determined as a function of a first predetermined training period, by means of the first training algorithm 403. The first training algorithm uses the first predetermined quantity Q of values from the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ and from the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ acquired by the first control means 201; 204, or received by the first control means 201; 204 or first diagnostic means, between a current sampling instant and the previous sampling instant of the at least one first diagnostic means.

Preferably, the at least one second diagnostic means may be arranged to determine the second reference value Mx', My', . . . by means of a second neural network 402'. The at least one first diagnostic means may be arranged to perform a first training of the second neural network 402', by means of a second training algorithm 403' associated with the second neural network 403. The first training of the second neural network may be performed using a second predetermined quantity Q of values of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_{i+1}, t_{i+2}, \ldots)$ and of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ previously acquired by the second control means 201', 204' or received by the second control means 201', 204' or the second diagnostic means 210*b*, 210'*b*.

After the first training is performed, the at least one second diagnostic means may be arranged to perform further training in a temporal succession of second training instants determined as a function of a second predetermined training period, by means of the second training algorithm 403'. The second training algorithm using the second predetermined quantity Q of values of the first plurality of values $x1(t_i, t_{i+1}, t_{i+2}, \ldots)$, $x2(t_i, t_{i+1}, t_{i+2}, \ldots)$; $y1(t_i, t_{i+1}, t_{i+2}, \ldots)$, $y2(t_i, t_i, t_{i+2}, \ldots)$ and of the second plurality of values $x1'(t'_i, t'_{i+1}, t'_{i+2}, \ldots)$, $x2'(t'_i, t'_{i+1}, t'_{i+2}, \ldots)$; $y1'(t'_i, t'_{i+1}, t'_{i+2}, \ldots)$, $y2'(t'_i, t'_{i+1}, t'_{i+2}, \ldots)$ acquired by the second control means 201', 204', or received by the second control means 201', 204' or by the second diagnostic means 210*b*, 210'*b*, between a current sampling instant and the previous sampling instant of the second diagnostic means.

Preferably, the first training algorithm 403 and/or the second training algorithm 403' is/are backpropagation algorithms.

The following are some of the motivations that may lead to the use of a neural network. If the observed operational quantity Y(t) is dependent on a plurality of operational quantities H(t), K(t), . . . J(t), a normalization process becomes complex.

If the observed operational quantity Y(t) is dependent on a plurality of operational quantities H(t), K(t), . . . J(t), it is possible to use the neural network as a self-learning and self-calibrating algorithm on board the train. The neural network may be set up to calculate continuously the reference value for the comparison of the plurality of values, advantageously avoiding the need for remote updates.

Figure 4:
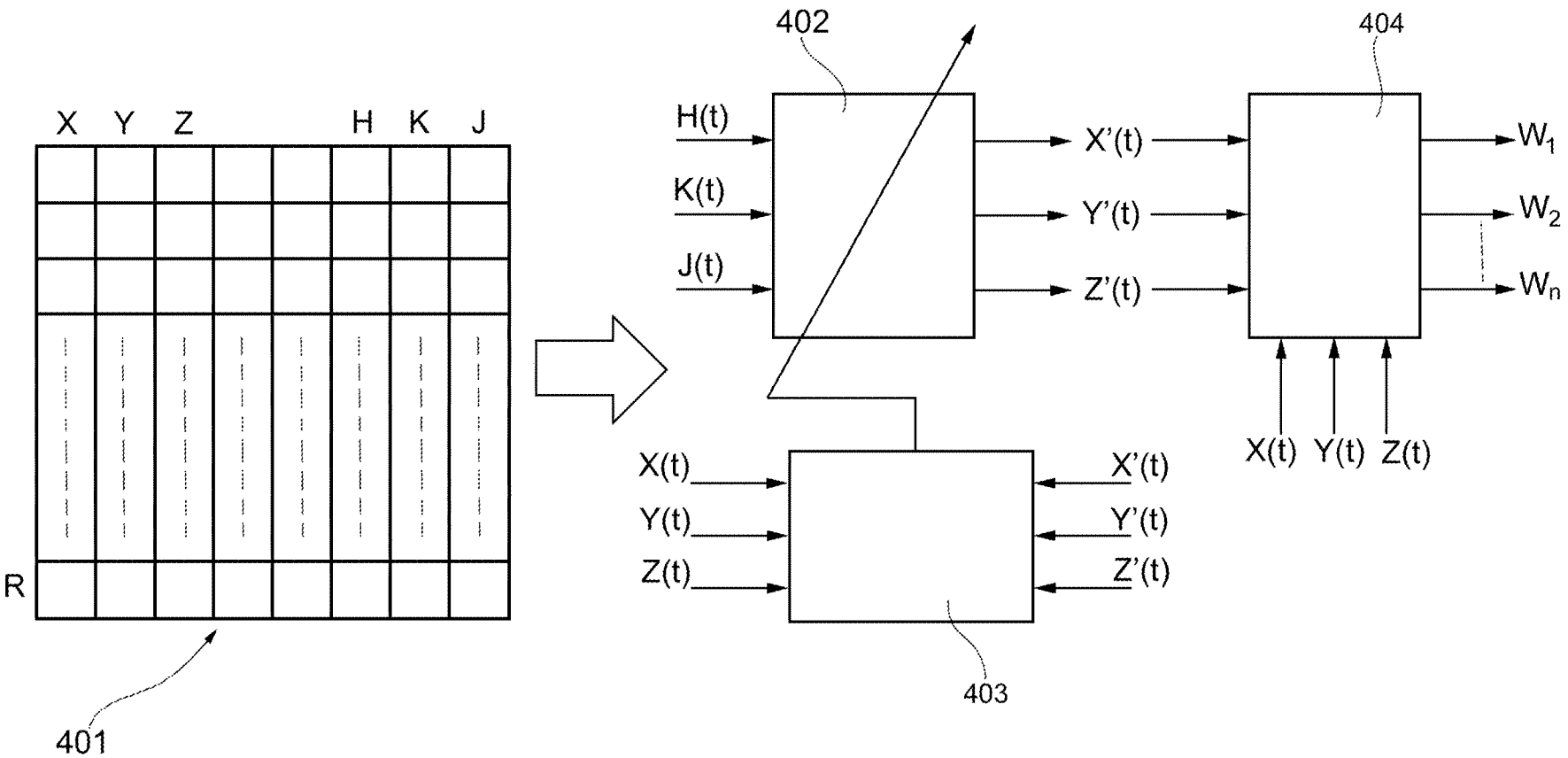
FIG. 4 shows an example of a circular buffer.

That which is described in the examples below for explanatory purposes based on FIG. 4 and FIG. 5 is described with reference to the first neural network, the at least one first control means, and the at least one first diagnostic means of the first convoy, but applies similarly to the second neural network, the at least one second control means, and the at least one diagnostic means of the second convoy.

In FIG. 4, for example, a circular buffer 401 has a size of R records, each R-th record being structured, for example, to host the one or more operational quantities X(t), Y(t), . . . Z(t) to be monitored, and the one or more operational quantities H(t), K(t), . . . J(t) of which the behavior depends on the behavior of the one or more operational quantities X(t), Y(t), . . . Z(t) to be monitored.

FIG. 5 shows in greater detail a possible format of the records contained in the circular buffer 401.

In the non-exclusive example of FIG. 5, the first record (denoted by subscript 1 in FIG. 5) is generated at the instant aT by a first of said control means of the first convoy and sent to the first diagnostic means 210, 210'. The first record contains the values $x_1(aT)$, $y_1(aT)$, $z_1(aT)$, $h_1(aT)$, $k_1(aT)$, $j_1(aT)$.

A second record (indicated by subscript 3 in FIG. 5) is generated at the instant aT by a third of said first control means and sent to the first diagnostic means 210, 210'. The second record contains the values $x_3(aT)$, $y_3(aT)$, $z_3(aT)$, $h_3(aT)$, $k_3(aT)$, $j_3(aT)$.

A third record (denoted by the subscript n in FIG. 5) is generated at the instant aT by an n-th of said first control means and sent to the diagnostic means 210, 210'. The third record contains the values $x_n(aT)$, $y_n(aT)$, $z_n(aT)$, $h_n(aT)$, $k_n(aT)$, $j_n(aT)$.

The r-1st record (denoted by subscript 2 in FIG. 5) is generated at the instant bT>aT by a second of said first control means and sent to the diagnostic means 210, 210'. The r-lst record contains the values $x_2(bT)$, $y_2(bT)$, $z_2(bT)$, $h_2(bT)$, $k_2(bT)$, $j_2(bT)$.

The r-th record (denoted by subscript 1 in FIG. 5) is generated at the instant bT>aT by the first of said first control means and sent to the diagnostic means 210, 210'. The r-th record contains the values $x_1(bT)$, $y_1(bT)$, $z_1(bT)$, $h_1(bT)$, $k_1(bT)$, $j_1(bT)$.

R must be sized to be able to store at least the number of records deemed necessary to perform effective training of the neural network.

Preferably, when there is more than one first diagnostic means, said first diagnostic means may be centralized in an electronic diagnostic unit 213 of the first convoy.

When there is more than one second diagnostic means, said second diagnostic means may be centralized in an electronic diagnostic unit 213' of the second convoy.

Preferably, when there is more than one first diagnostic means, said first diagnostic means may be distributed over a plurality of first control means of the first convoy. When there is more than one second diagnostic means, said second diagnostic means may be distributed over a plurality of second control means of the second convoy.

Preferably, the at least one operational quantity X(t), Y(t), . . . may comprise values directly acquired or generated by the first control means and/or the second control means, or values entered from the outside manually or remotely, for example via a maintenance software tool.

Or, for example for the object of preparing data for diagnostic analyses, preferably, the at least one operational quantity X(t), Y(t), . . . may comprise values derived from preprocessing performed by the first control means on the at least one operational quantity directly acquired or generated by the first control means, and/or, the at least one operational quantity X(t), Y(t), . . . may comprise values derived from preprocessing performed by the second control means on the at least one operational quantity directly acquired or generated by the second control means.

In other words, the at least one first control means 201, 204 may be arranged to perform preprocessing functions 208, 207 on the quantities represented by the signals 203, 206, and the at least one second control means 201', 204' may be arranged to perform preprocessing functions 208', 207' on the quantities represented by the signals 203', 206'.

In the event that the plurality of homogeneous devices belongs to braking systems 102, the preprocessing functions 207, 208; 207', 208' may include braking pressure application counters at the brake cylinders over a given period of time, the distance traveled in a given period of time obtained by integrating the speed signals from the axles over time, and the number of activations of each pneumatic solenoid valve in a given period of time.

In the event wherein the plurality of homogeneous devices belongs to door systems 103, the preprocessing functions 207, 208; 207', 208' may comprise identifiers of the maximum peak value of the current to the door actuation motors, or counters of the number of openings of each door in a given period of time, or the total electrical energy consumed by each electric motor for moving the doors in a given period of time.

The at least one first control means 201, 204 may share the quantities represented by the signals 203, 206, respectively, possibly preprocessed by the preprocessing functions 208, 207, respectively, by means of the second communication means 211, for example of the wired or wireless type. The at least one second control means 201', 204' may also share the quantities represented by the signals 203', 206', respectively, possibly preprocessed by the preprocessing functions 208', 207', respectively, via the third communication means 211', for example of a wired or wireless type.

Preferably, the at least one first diagnostic means and/or the at least one second diagnostic means may each be arranged to provide diagnostic indications divided according to at least two levels of severity.

Preferably, the at least one first diagnostic means may be arranged to transmit the diagnostic indications to an additional unit or module 214 on board the first convoy, and/or, the at least one second diagnostic means may be arranged to transmit the diagnostic indications to an additional unit or module 214' on board the second convoy.

The definition of operational quantity X(t), Y(t), . . . common to the plurality of homogenous devices 202, 205, 202', 205' is explained in detail below.

"Common operational quantity X(t), Y(t), . . . " refers to a quantity having the same meaning and the same dimensions, and which is associated with at least two devices forming part of a plurality of homogeneous devices 202, 205, 202', 205'.

A first non-exclusive example of operational quantity X(t) is represented by the current absorbed by each electric actuating motor of each of the door systems 103 of at least one vehicle from the first convoy T1 (for example, a rail vehicle from a first railway convoy) and at least one vehicle from the second convoy T2 (e.g., a rail vehicle from a second railway convoy), where x1 (t) is the current absorbed by a first homogeneous device, i.e., a first electric motor associated with a first door 103, x2(t) is the current absorbed by a second homogeneous device, i.e., a second electric motor associated with a second door 103, xn(t) is the current absorbed by an n-th homogeneous device, i.e., an n-th electric motor associated with an n-th door 103.

A second non-exclusive example of operational quantity Y(t), different from X(y), is represented by the set of pulse counters for activating the braking solenoid valve belonging to each of the braking systems 102 of at least one vehicle from the first convoy T1 (e.g., a rail vehicle from a first railway convoy) and at least one vehicle from the second convoy T2 (e.g., a rail vehicle from a second railway convoy), where y1(t) is the value of the activation pulse counter of a first homogeneous device, i.e., of the braking solenoid valve belonging to a first braking system 102, y2(t) is the value of the activation pulse counter of a second homogeneous device, i.e., of the braking solenoid valve belonging to a second braking system 102, and yn(t) is the value of the pulse counter for activation of an n-th homogeneous device, i.e., of the braking solenoid valve belonging to an n-th braking system 102.

A third non-exclusive example of an operational quantity Z(t), different from X(y), is shown by the set of brake pad thickness values (or brake shoes) belonging to each braking unit 102 of at least one vehicle in the first convoy T1 (e.g., a rail vehicle of a first railway convoy) and at least one vehicle in the second convoy T2 (e.g., a rail vehicle of a second railway convoy). The thickness value of the brake pad (or brake shoe) being an indication of the level of consumption of the friction material. In the example, z1(t) is the thickness of the brake pad belonging to a first braking unit 102, z2(t) is the thickness of the brake pad belonging to a second homogeneous device, i.e., the brake pad (or brake shoe) belonging to a second braking unit 102, zn(t) is the thickness of the brake pad (or brake shoe) of an n-th homogeneous device, i.e., the brake pad belonging to an n-th braking unit 102.

In the following an example embodiment is provided that clarifies the use of the neural network. The example refers to the first neural network and is not repeated for the second neural network. It is clear that this example embodiment may be applied analogously to the second neural network. The first neural network may be arranged to receive as input at least one operational quantity H(t), K(t), . . . J(t) and to generate as output at least one image quantity X'(t), Y'(t), . . . Z'(t), associated with the respective homogeneous quantity to be monitored X(t), Y(t), . . . Z(t).

The first training algorithm may be arranged to receive the operational quantities X(t), Y(t), . . . Z(t) to be monitored and the image quantities X'(t), Y'(t), . . . Z'(t) and to act on the internal coefficients of the first neural network by minimizing the error existing between each operational quantity X(t), Y(t), . . . Z(t) to be monitored and the associated image operational quantity X'(t), Y'(t), . . . Z'(t).

The at least one first diagnostic means 210, 210' may receive records from the at least one first control means 201, 204 via the second communication means 211 and may provide for storing them in the circular buffer.

If necessary, the transmission of the records by the at least one first control means 201, 204 to the at least one first diagnostic means 210, 210' may take place in a synchronized manner to ensure the temporal congruence of the transmitted records. The time value of the transmission instant of the single record by the first control means 201, 204 may become one of the operational quantities H(t), K(t), . . . J(t). The same may be applied similarly to the second diagnostic means.

When the buffer has accumulated a quantity of records Q≤R, the at least one first diagnostic means 210, 210' may start the training process of the first neural network by activating the first training algorithm, which will use the set Q of records to perform the training action.

The parameter Q may be defined non-exclusively in the design phase of the at least first diagnostic means 210, 210' on the basis of experience relating to how long it is necessary to accumulate a significant number of records useful for a reliable training of the first neural network.

By way of non-exclusive example, significant information for diagnostic use may be stored for a period of one hour, and therefore a training based on the history of six months of service, 16 hours of daily service, requires 2,880 records transmitted respectively by the at least one first control means 201, 204 associated with the operational quantities X(t), Y(t), . . . Z(t), H(t), K(t), . . . J(t) during the first six months of service, so in this case Q=2,880·U, where U is the number of first control means associated with the operational quantities X(t), Y(t), . . . Z(t), H(t), K(t), . . . J(t).

During the accumulation period of the quantity Q of records, which occurs when the vehicle has just been tested and just put into service, the devices associated with the operational quantities y1, y2, . . . yn to be monitored must therefore perform their function correctly, i.e., they are free from malfunction or fault.

A malfunction condition associated with the value yn(t) during the collection of Q records would give rise to an incorrect set of data with consequent incorrect training of the first neural network with regard to the operational quantity Y(t).

By way of example, this disadvantage may be overcome by evaluating the samples of the quantities to be monitored during the accumulation phase of the Q records, with the previously described statistical methods, eliminating the deviant value from the training process and generating an alarm report.

After the training, the image quantities X'(t), Y'(t), . . . Z'(t) are considered reliably representative of the real behavior of the associated operational quantities X(t), Y(t), . . . Z(t) to be monitored.

Once the training has been performed, for each new n-th incoming record, the at least one first diagnostic means 210, 210' may be arranged to pass the plurality of incoming values of the operational quantities H(t), K(t), . . . J(t) directly to the first neural network 402 and may activate a comparison algorithm 404 arranged to compare each operational quantity X(t), Y(t), . . . Z(t) to be monitored with each value of the associated operational image quantity X'(t), Y'(t), Z'(t) and to generate an associated status report W1, W2, . . . Wn.

The comparison algorithm 404 may operate, for example, by checking that the differences between each value of the operational quantity X(t), Y(t), . . . Z(t) to be monitored and each value of the associated image quantity X'(t), Y'(t), . . . Z'(t) do not exceed predetermined values ΔM1, ΔM2, each associated with the operational quantities X(t), Y(t), . . . Z(t) to be monitored. The preset values ΔM1, ΔM2, . . . ΔMn being stored in the portion of the non-volatile memory associated with the at least one first diagnostic means 210, 210'.

Further, the comparison algorithm 404 may operate, for example, by checking that the derivatives of the differences between each value of the operational quantity X(t), Y(t), . . . Z(t) to be monitored and each value of the associated image quantity X'(t), Y'(t), . . . Z'(t) do not exceed predetermined values ΔD1, ΔD2, . . . ΔDn, associated with the operational quantities X(t), Y(t), Z(t) to be monitored, stored in the non-volatile memory portion associated with the at least one first diagnostic means 210, 210'.

The diagnostic information W1, W2, . . . Wn may assume, for example, a range of at least two values indicating at least two levels of severity of the state of the associated observed operational quantity, for example but not exclusively PASS, FAIL.

The at least one first diagnostic means 210, 210' may be arranged to take into account environmental and/or operational variations of the convoy over its life.

In said case, the at least one first diagnostic means 210, 210' may continue to store the incoming records in the circular buffer 401, and periodically activate the first training algorithm 403 to update internal coefficients of the first neural network 402 according to the new operational conditions, keeping the image quantities X'(t), Y'(t), . . . Z'(t) accurate continuously over time, advantageously, without the need for external correction or recalibration.

A further advantage of using the solution described in FIG. 4 is represented by the fact that a suitably sized neural network becomes extremely representative of the history prior to the last data stored in the circular buffer 401. By being able to download the coefficients of the first neural network 402 during the maintenance phase of the associated device 202, 205, the history of said associated device may be obtained with good approximation.

The limitations of the embodiment disclosed above constitute a currently preferred embodiment but may be varied without thereby departing from the broader scope defined in the main claim.

As described above, this invention may preferably be applied to the railway vehicle/convoy sector traveling on tracks. For example, a vehicle as referred to herein may be a locomotive or a carriage, and a course/route may include tracks on which the wheels of the locomotive roll. The embodiments described herein are not intended to be limited to vehicles on rails. For example, the vehicle may be a car, a truck (for example a highway semi-trailer truck, a mining truck, a truck for transporting timber, etc.), or the like, and the route may be a road or a trail. For example, a convoy includes a plurality of said vehicles connected or associated with each other.

The advantage achieved is therefore that of obtaining a solution which resolves the counterproductive cases of known monitoring systems, through a solution with reduced complexity and costs.

Various aspects and embodiments of a monitoring system for at least one plurality of homogenous devices according to the invention have been described. It is understood that each embodiment may be combined with any other embodiment. Furthermore, the invention is not limited to the described embodiments, but may be varied within the scope defined by the appended claims.

The invention claimed is:

1. A monitoring system comprising:

a first communication system arranged for a first control unit to transmit plural first values to a second control unit and for the second control unit to transmit plural second values to the first control unit, the first control unit arranged to be installed in a first convoy of vehicles and to acquire the first values of at least one operational quantity of a first plurality of devices installed in the first convoy, and the second control unit arranged to be installed in a second convoy of vehicles and to acquire the second values of said at least one operational quantity of a second plurality of devices that are installed in the second convoy and homogeneous with the first plurality of devices;

at least one first diagnostic unit arranged to be installed in the first convoy and to:

receive, via a second communication system, the first values;

receive from the first control unit the second values received by the first control unit from the second control unit; and detect a malfunction or a maintenance request by at least one device of said first plurality of devices as a function of a comparison of the first values with at least one first range of reference values; and at least one second diagnostic unit arranged to be installed in the second convoy and to: receive, via a third communication system, the second values;

receive from the second control unit the first values received by the second control unit from the first control unit; and detect a malfunction or a maintenance request by at least one device of said second plurality of devices as a function of a comparison of said second values with at least one second range of reference values;

wherein the first range of reference values comprises a first reference value and a first neighborhood of values associated with the first reference value, the first diagnostic unit arranged to determine the first reference value as a function of at least one of the first values and at least one of the second values, wherein the second range of reference values comprises a second reference value and a second neighborhood of values associated with the second reference value, the second diagnostic unit arranged to determine the second reference value as a function of at least one of the second values and at least one of the first values, and wherein at least one of the first neighborhood of values or the second neighborhood of values is associated with one or more of a constant neighborhood, a percentage value of the respective reference value, a percentage of an average of the respective reference value, a function of the variance of the at least one respective operational quantity, or a tolerance band around the average.

2. The system of claim 1, wherein the first communication system is a wireless communication system, and wherein, when the first control unit and the second control unit are located from each other at a distance shorter than a predetermined distance threshold: the first control unit is arranged to transmit the first values to the second control unit via the wireless communication system; and the second control unit is arranged to transmit the second values to the first control unit via the wireless communication system.

3. The system of claim 2, wherein the wireless communication system comprises a first mesh network included in the first convoy and a second mesh network included in the second convoy.

4. The system of claim 1, wherein the first communication system is a radio communication system, and wherein when the first control unit and the second control unit are at any distance from each other:

the first control unit is arranged to transmit the values to the second control unit via the radio communication system; and the second control unit is arranged to transmit the second values to the first control unit via the radio communication system.

5. The system of claim 1, wherein:

the first diagnostic unit is arranged to detect the malfunction or the maintenance request by the at least one device of the first plurality of devices when at least one value of said first values is not within the first range of reference values; and/or the second diagnostic unit is arranged to detect the malfunction or the maintenance request by the at least one device of the second plurality of devices when at least one value of said second values is not within the second range of reference values.

6. The system of claim 1, wherein:

the at least one first control unit is arranged to acquire the first values in a temporal succession of first acquisition instants determined according to a first predetermined acquisition period, each value of said first values being representative of a functional state, at one of said first acquisition instants, of a respective device of said first plurality of devices; the at least one second control unit is arranged to acquire the second values in a temporal succession of second acquisition instants determined according to a second predetermined acquisition period, each value of said second values being representative of a functional state, at one of said second acquisition instants, of a respective device of said second plurality of devices;

the at least one first diagnostic unit is arranged to detect the malfunction or the maintenance request by the at least one device of said first plurality of devices as the function of the comparison for each of said first acquisition instants of the first values with the at least one first range of reference values;

the at least one second diagnostic unit is arranged to receive, via the third communication system, the second values acquired in one of said second acquisition instants, and to detect the malfunction or the maintenance request by the at least one device of said second plurality of devices as the function of the comparison for each of said second acquisition instants of said second values with the at least one second range of reference values;

the first diagnostic unit is arranged to determine the first reference value as a function of the at least one of the first values acquired in one of said first acquisition instants and the at least one of the second values acquired in one of said second acquisition instants; and the second diagnostic unit is arranged to determine the second reference value as a function of the at least one of the second values acquired in one of said second acquisition instants and the at least one of the first values acquired in one of said first acquisition instants.

7. The system of claim 6, wherein the first diagnostic unit is arranged to determine the first reference value at each of said first acquisition instants, and/or the second diagnostic unit is arranged to determine the second reference value at each of said second acquisition instants.

8. The system of claim 6, wherein:

the first diagnostic unit is arranged to determine the first reference value by calculating an average between at least one value of said first values acquired in one of said first acquisition instants and at least one value of said second values acquired at one of said second acquisition instants; and/or the second diagnostic unit is arranged to determine the second reference value by calculating an average between at least one value of said first values acquired in one of said first acquisition instants and at least one value of said second values acquired at one of said second acquisition instants.

9. The system of claim 6, wherein the first diagnostic unit is arranged to:

determine a first average value by calculating an average of the values of said first values acquired in one of said first acquisition instants and said second values acquired in one of said second acquisition instants;

identify the values of said first values and said second values which are higher or lower than at least one first threshold value with respect to the first average value; and determine the first reference value through the determination of a second average value by calculating the average of the values of said first values and said second values that have not been identified to be higher or lower than the at least one first threshold value with respect to the first average value.

10. The system of claim 1, wherein the first diagnostic unit is arranged to determine the first neighborhood of values as a function of a first percentage value of the first reference value, and/or wherein the second diagnostic unit is arranged to determine the second neighborhood of values as a function of a second percentage value of the second reference value.

11. The system of claim 1, wherein the first diagnostic unit is arranged to determine the first neighborhood of values as a function of a first variance of the at least one operational quantity, and/or wherein the second diagnostic unit is arranged to determine the second neighborhood of values as a function of a second variance of the at least one operational quantity.

12. The system of claim 1, wherein the at least one operational quantity comprises a first operational quantity and a second operational quantity, and wherein the first diagnostic unit and/or the second diagnostic unit are each arranged to normalize the first operational quantity as a function of the second operational quantity.

13. The system of claim 1, wherein the first diagnostic unit is arranged to determine the first reference value using a first neural network, and/or wherein the second diagnostic unit is arranged to determine the second reference value using a second neural network.

14. The system of claim 13, wherein the first diagnostic unit is arranged to perform a first training of said first neural network with a first training algorithm associated with said first neural network, the first training of the first neural network being performed using a first predetermined quantity of values of said first values and said second values previously acquired by the first control unit or received by the first control unit or the first diagnostic unit.

15. The system of claim 14, wherein, after the first training has been performed, the first diagnostic unit is arranged to perform further training in a temporal succession of first training instants determined as a function of a first predetermined training period, using the first training algorithm, the first training algorithm using the first predetermined quantity of values of said first values and said second values acquired by the first control unit or received by the first control unit, or first diagnostic unit, between a current sampling instant and the previous sampling instant of said first diagnostic unit.

16. The system of claim 14, wherein at least one of the first training algorithm or the second training algorithm comprises a backpropagation algorithm.

17. The system of claim 1, wherein the at least one first diagnostic unit comprises at least two first diagnostic units that are centralized in an electronic diagnostic unit of the first convoy; and/or wherein the at least one second diagnostic unit comprises at least two second diagnostic units that are centralized in an electronic diagnostic unit of the second convoy.

18. The system of claim 1, wherein the at least one first diagnostic unit comprises at least two first diagnostic units that are distributed over a plurality of first control units of the first convoy; and/or wherein the at least one second diagnostic unit comprises at least two second diagnostic units that are distributed over a plurality of second control units of the second convoy.

19. The system of claim 1, wherein the first diagnostic unit and/or the second diagnostic unit are each arranged to provide diagnostic indications divided according to at least two levels of severity.

20. A monitoring system comprising:

at least one first control unit arranged to be included in a first convoy of a transportation system that includes the first convoy, a second convoy, and a plurality of homogeneous devices, wherein a first portion of the homogeneous devices of said plurality of homogeneous devices is arranged to be installed in the first convoy, and a second portion of the homogeneous devices of said plurality of homogeneous devices is arranged to be installed in the second convoy, and wherein a functional state of each device of said plurality of homogeneous devices is represented by a respective value of at least one operational quantity, common to said plurality of homogeneous devices, and wherein the at least one first control unit is arranged to acquire, in a temporal succession of first acquisition instants determined according to a first predetermined acquisition period, a first plurality of values of said at least one operational quantity, each value of said first plurality of values being representative of the functional state, at one of said first acquisition instants, of a respective device of said first portion of devices that is installed in the first convoy;

at least one second control unit arranged to be included in the second convoy and arranged to acquire, in a temporal succession of second acquisition instants determined according to a second predetermined acquisition period, a second plurality of values of said at least one operational quantity, each value of said second plurality of values being representative of the functional state, at one of said second acquisition instants, of a respective device of said second portion of devices that is installed in the second convoy; and at least one first diagnostic unit arranged to be included in the first convoy, at least one second diagnostic unit arranged to be included in the second convoy, and a first communication system arranged for the at least one first diagnostic unit to transmit the first plurality of values to the at least one second diagnostic unit and for the at least one second diagnostic unit to transmit the second plurality of values to the at least one first diagnostic unit;

wherein the first diagnostic unit is arranged to:

receive, via a second communication system, the first plurality of values acquired in one of said first acquisition instants;

receive, from the second diagnostic unit, the second plurality of values; and detect a malfunction or a maintenance request by at least one device of said first portion of devices which is installed in the first convoy, according to a comparison for each of said first acquisition instants of the received first plurality of values with at least one first range of reference values;

wherein the second diagnostic unit is arranged to:

receive, via a third communication system, the second plurality of values acquired in one of said second acquisition instants;

receive, from the first diagnostic unit of the first convoy, the first plurality of values; and detect a malfunction or a maintenance request from at least one device of said second portion of devices which is installed in the second convoy, according to a comparison for each of said second acquisition instants, of the received second plurality of values, with at least one second range of reference values;

wherein the first range of reference values comprises a first reference value and a first neighborhood of values associated with said first reference value, the first reference value being determined by the first diagnostic unit as a function of at least one value of said first plurality of values acquired in one of said first acquisition instants and at least one value of said second plurality of values acquired in one of said second acquisition instants wherein the second range of reference values comprises a second reference value and a second neighborhood of values associated with said second reference value, the second reference value being determined by the second diagnostic unit as a function of at least one value of said second plurality of values acquired in one of said second acquisition instants and at least one value of said first plurality of values acquired in one of said first acquisition instants, and wherein at least one of the first neighborhood of values or the second neighborhood of values is associated with one or more of a constant neighborhood, a percentage value of the respective reference value, a percentage of an average of the respective reference value, a function of the variance of the at least one respective operational quantity, or a tolerance band around the average.

* * * * *